US008484037B2

(12) United States Patent
Tashiro et al.

(10) Patent No.: US 8,484,037 B2
(45) Date of Patent: Jul. 9, 2013

(54) BANDWIDTH EXTENSION APPARATUS FOR AUTOMATICALLY ADJUSTING THE BANDWIDTH OF INPUTTED SIGNAL AND A METHOD THEREFOR

(75) Inventors: Atsushi Tashiro, Tokyo (JP); Hiromi Aoyagi, Kanagawa (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 717 days.

(21) Appl. No.: 12/659,826

(22) Filed: Mar. 23, 2010

(65) Prior Publication Data

US 2010/0246803 A1 Sep. 30, 2010

(30) Foreign Application Priority Data

Mar. 30, 2009 (JP) ..... 2009-082690

(51) Int. Cl.
*G10L 19/00* (2006.01)

(52) U.S. Cl.
USPC ..... 704/500; 704/268

(58) Field of Classification Search
USPC ..... 704/262–269, 500
See application file for complete search history.

(56) References Cited

U.S. PATENT DOCUMENTS

| | | | | |
|---|---|---|---|---|
| 6,539,355 | B1 * | 3/2003 | Omori et al. | 704/268 |
| 6,711,538 | B1 * | 3/2004 | Omori et al. | 704/223 |
| 7,359,854 | B2 * | 4/2008 | Nilsson et al. | 704/219 |
| 7,546,237 | B2 * | 6/2009 | Nongpiur et al. | 704/209 |
| 7,792,680 | B2 * | 9/2010 | Iser et al. | 704/500 |
| 7,912,729 | B2 * | 3/2011 | Nongpiur et al. | 704/500 |
| 8,145,478 | B2 * | 3/2012 | Iwata | 704/224 |
| 8,311,840 | B2 * | 11/2012 | Giesbrecht et al. | 704/500 |

FOREIGN PATENT DOCUMENTS

JP 2000-134162 A 5/2000

* cited by examiner

*Primary Examiner* — Simon Sing
(74) *Attorney, Agent, or Firm* — Rabin & Berdo, P.C.

(57) ABSTRACT

A bandwidth extension apparatus can generate from an inputted speech signal a bandwidth-extended signal whose bandwidth is automatically adjusted according to the surrounding hearing situation by means of a parameter. The apparatus has a surrounding characteristic predictor for predicting the characteristic amount of the surrounding sound of the phone terminal on which the apparatus is installed; an adjustment amount predictor for comparing the characteristic amount with the parameter to predict the adjustment amount for the parameter; a speech characteristic predictor for predicting the characteristic amount of the inputted speech signal; and an adjustment amount determiner for determining an adjustment amount for updating the parameter based on the characteristic amount of the surrounding sound and the inputted speech signal.

8 Claims, 5 Drawing Sheets

BANDWIDTH EXTENSION APPARATUS FOR AUTOMATICALLY ADJUSTING THE BANDWIDTH OF INPUTTED SIGNAL AND A METHOD THEREFOR

BACKGROUND OF THE INVENTION

1. Field of the Invention

The present invention relates to a bandwidth extension apparatus and a method therefor, particularly for expanding the bandwidth of a sound signal having its frequency band limited by generating and adding a frequency component higher than the upper limit of the frequency band.

2. Description of the Background Art

For example, telephone communication systems conveying speech signals have the frequency band thereof limited to the range from 0.3 kHz to 3.4 kHz, which is so much narrower than the frequency range of genuine human voices. Therefore, the quality of speech signals transmitted over telephone systems is somewhat deteriorated to the level of muffled voice.

In order to solve the above-described problem, some solutions have been proposed to improve the quality of received speech signals by extending the frequency band of the received speech signals to its higher frequency region. One of the solutions is disclosed, for example, by Japanese patent laid-open publication No. 2000-134162 to Omori, et al.

In the method disclosed in Omori, et al., a received speech signal, i.e. lowband signal, is used to generate a signal component higher in frequency than the lowband signal, and the latter component, i.e. highband signal, is added to the lowband signal to thereby produce a speech signal having its frequency band wider than the bandwidth of the received signal. The method of Omori, et al., is characterized in that the additive ratio of highband signal to lowband signal is adjustable by manual control from the outside.

However, the method described in Omori, et al., involves a problem that the manual adjustment of the additive ratio requires much more time and higher skill, and is therefore rather difficult for ordinary users.

Among various bandwidth extension solutions, there is one in which the user or service engineer can adjust and control the characteristics for use in generating a highband signal. It is, however, also difficult for them to do the adjustment and control effectually.

SUMMARY OF THE INVENTION

It is, therefore, an object of the present invention to provide a bandwidth extension apparatus and a method therefor which is capable of a bandwidth-extended signal whose bandwidth is adaptively adjusted according to the environment such as surrounding hearing condition.

In accordance with the present invention, a bandwidth extension apparatus for extending the frequency bandwidth of an inputted speech signal in accordance with a parameter comprises: a surrounding characteristic predictor for collecting the surrounding sound of a place where the bandwidth-extended speech signal will be output, then estimating the characteristic of the surrounding sound, and predicting the amount of the characteristic; an adjustment amount predictor for comparing the amount of the characteristic with the parameter to predict an adjustment amount for the parameter; a speech characteristic predictor for estimating the characteristic of the inputted speech signal, and then predicting the amount of the characteristic of the inputted speech signal; and an adjustment amount determiner for comparing the amounts of characteristics of the surrounding sound and the inputted speech signal with each other to determine an effective or predominant adjustment amount which will be applied to bandwidth extension, and updating the parameter.

According to the present invention, a bandwidth extension apparatus for extending the frequency bandwidth of an inputted speech signal in accordance with a parameter comprises: a first surrounding characteristic predictor for collecting the surrounding sound of a place where the bandwidth-extended speech signal will be output, then estimating the characteristic of the surrounding sound, and predicting the amount of the characteristic; a second surrounding characteristic predictor for converting the surrounding sound to a signal having a characteristic substantially equivalent to the inputted speech signal, and using the parameter used for bandwidth extension to predict the amount of the characteristic of the converted surrounding sound; an adjustment amount predictor for predicting a parameter such that the amount of the characteristic of said second surrounding characteristic predictor is made approximate to the amount of the characteristic of said first surrounding characteristic predictor, and then predicting an adjustment amount for the parameter; a speech characteristic predictor for estimating the characteristic of the inputted speech signal, and then predicting the amount of the characteristic of the inputted speech signal; and an adjustment amount determiner for comparing the amounts of characteristics of the surrounding sound and the inputted speech signal with each other to determine an effective adjustment amount which will be applied to the bandwidth extension, and updating the parameter.

Further according to the present invention, a bandwidth extension method for extending the frequency bandwidth of an inputted speech signal in accordance with a parameter comprises the steps of: collecting the surrounding sound of a place where the bandwidth-extended speech signal will be output, then estimating the characteristic of the surrounding sound, and predicting the amount of the characteristic; comparing the amount of the characteristic with the parameter to predict an adjustment amount for the parameter; estimating the characteristic of the inputted speech signal, and then predicting the amount of the characteristic of the inputted speech signal; and comparing the amounts of characteristics of the surrounding sound and the inputted speech signal with each other to determine an effective adjustment amount for the parameter which will be applied to bandwidth extension, and updating the parameter.

Still further according to the present invention, the bandwidth extension method for extending the frequency bandwidth of an inputted speech signal in accordance with a parameter comprises the steps of: collecting the surrounding sound of a place where the bandwidth-extended speech signal will be output, then estimating the characteristic of the surrounding sound, and predicting the amount of the first surrounding characteristic as a first characteristic amount; converting the surrounding sound to a signal having a characteristic substantially equivalent to the inputted speech signal, and using the parameter used for bandwidth extension to predict the amount of the characteristic of the converted surrounding sound as a second characteristic amount; predicting a parameter such that the second characteristic amount is made approximate to the first characteristic amount, and then predicting an adjustment amount for the parameter; estimating the characteristic of the inputted speech signal, and then predicting the amount of the characteristic of the inputted speech signal; and comparing the amounts of characteristics of the surrounding sounds and the inputted speech signal with each other to determine an effective adjustment amount which will be applied to bandwidth extension, and updating the parameter.

In an aspect of the present invention, a bandwidth extension apparatus can generate from an inputted speech signal a bandwidth-extended signal whose bandwidth is automatically adjusted according to the surrounding hearing situation by means of a parameter. The apparatus has a surrounding characteristic predictor for predicting the characteristic amount of the surrounding sound of the phone terminal on which the apparatus is installed; an adjustment amount predictor for comparing the characteristic amount with the parameter to predict the adjustment amount for the parameter; a speech characteristic predictor for predicting the characteristic amount of the inputted speech signal; and an adjustment amount determiner for determining an adjustment amount for updating the parameter based on the characteristic amount of the surrounding sound and the inputted speech signal.

In accordance with the present invention, a bandwidth extender apparatus and a method therefor will be provided which can generate a bandwidth-extended signal automatically adjusted according to the surrounding hearing situation and the like.

In the context, the term "speech signal" may more broadly be comprehended so as to cover the possibility of including audible sound other than voice.

The inventive concept disclosed in the application may also be defined in ways other than in the claims presented below. The inventive concept may consist of several separate inventions particularly if the invention is considered in light of explicit or implicit subtasks or from the point of view of advantages achieved. In such a case, some of the attributes included in the claims may be superfluous from the point of view of separate inventive concepts. Within the framework of the basic inventive concept, features of different embodiments are applicable in connection with other embodiments.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENTS

Figure 1:
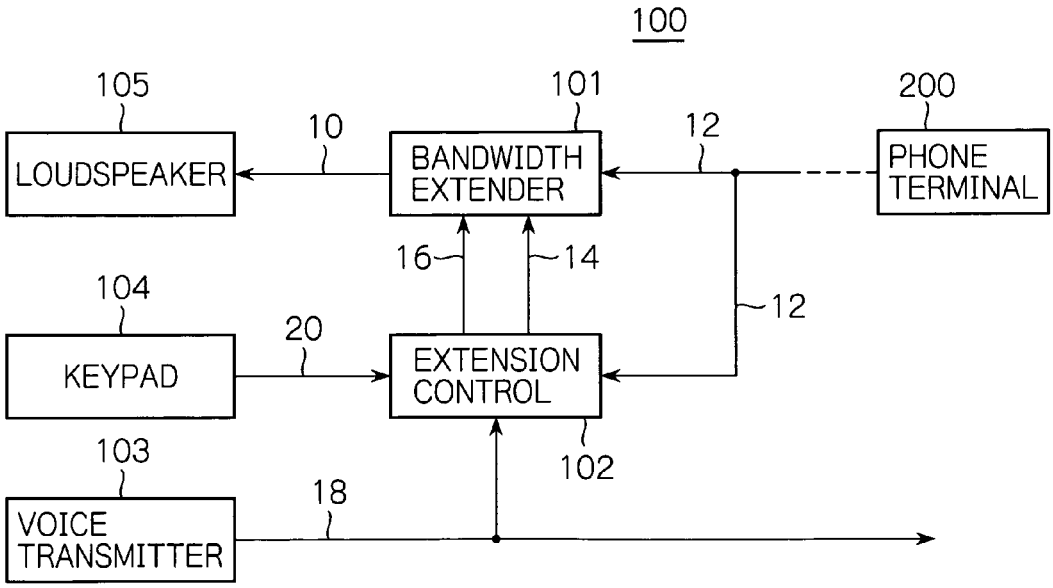
FIG. 1 is a schematic block diagram that shows a configuration of a bandwidth extension apparatus according to an embodiment of the present invention.

In the following, preferred embodiments of a bandwidth extension apparatus in accordance with the invention will be described in detail with reference to the accompanying drawings. Referring initially to FIG. 1, there is shown a preferred embodiment of a bandwidth extension apparatus 100 in accordance with the present invention.

The bandwidth extension apparatus 100 of the instant illustrative embodiment is adapted for extracting a noise component from an input signal captured on the receiving end when receiving a voice signal transmitted from a distal end over a telephone switching system, and for adjusting the proportion of the components of the voice signal, when being extended in bandwidth, according to the amount of the noise component, thereby making it possible to clearly listen to the voice.

FIG. 1 schematically shows in a block diagram the structure of the main part of the bandwidth extension apparatus 100. As seen from FIG. 1, the bandwidth extension apparatus 100 of the embodiment may be equipped on a telephone terminal, such as a telephone subscriber set or handset, on a land or mobile phone system, which is capable of transmitting and receiving a speech signal 12 to and from another phone terminal 200 over a telephone switching system, not specifically shown in the figure. The bandwidth extension apparatus 100 comprises a bandwidth extender 101, an extender control 102, a voice transmitter 103, a keypad 104 and a loudspeaker 105, which are interconnected as illustrated. Signals or information are designated with reference numerals of connections on which they are conveyed.

The phone terminal including the bandwidth extension apparatus 100 may be implemented in the form of hardware, or in the form of software, such as a soft-phone, which is implemented by a processor system including a CPU (Central Processor Unit) and program sequences installed in and executed by the processor system, where the functional phase of the apparatus can be presented in the form of block diagram as shown. It is to be noted that such depiction and a description do not restrict the apparatus 100 to an implementation only in the form of hardware but at least a part or the entirety of the apparatus 100 may be implemented by software. In the latter case, signals or information may be of digital data. That may also be the case with an alternative embodiment which will be described below. In this connection, the word "circuit" may be understood not only as hardware, such as an electronics circuit, but also as a function that may be implemented by software installed and executed on a processor system.

The bandwidth extender 101 is adapted to produce a bandwidth-extended signal 10 from the received speech signal 12 either by applying parameter information, or signal, 14 when an operation signal 16 indicates to operate bandwidth extension, or by making the received speech signal 12 pass through as it is when the operation signal 16 does not indicate to operate bandwidth extension.

In the illustrative embodiment, the bandwidth extender 101 may be implemented by applying a bandwidth extension which, for example, uses wideband codebook, LPC (Linear Predictive Coding) synthesis and a highband-suppress, or elimination, filter as described in Omori, et al. In this embodiment, the parameter information applied to the extender 101 may represent the profile, or contour, of a filtering characteristic, i.e. the shape of a frequency response curve, of the highband-suppress filter. Alternatively, a variety of wideband codebooks are prepared for respective power levels of excitation vectors, and parameter information may specify appropriate one of the codebooks. Further alternatively, the LPC synthesis filter may be adapted to have a variable circuit provided on the input stage of a filter coefficient ($\alpha$) for selectively controlling its filter coefficient to receive the value of filter coefficient as parameter information.

However, the bandwidth extension scheme applicable to the extender 101 is not restricted to the method described in Omori, et al. It is possible to use a scheme which does not use LPC synthesis or which generates a quasi-highband signal analytically instead of using wideband codebooks so far as such bandwidth extension schemes generate highband signals whose characteristic depends on the parameter. The parameter information may be defined according to the bandwidth extension scheme applied.

The loudspeaker 105 may be an electro-acoustic transducer, such as a common loudspeaker, headphone or earphone, and is adapted to output vocal sound carried on the received speech signal 12 supplied from the extender 101 or the bandwidth-extended signal 10 as it is.

The voice transmitter 103 is an acousto-electric transducer, which may be a microphone built-in the telephone terminal or installed on the headset and so on, and is adapted to sense or capture sound around the user of the telephone terminal, or proximal talker, having the bandwidth extension apparatus 100 installed to produce a corresponding electric signal as a speech signal 18. The sending speech signal 18, a speech signal to be transmitted, may have its bandwidth as narrow as the received speech signal 12, or as wide as the bandwidth-extended signal 10.

The keypad 104 is a manual control unit manipulable by the user in order to instruct the extender control 102 whether or not the signal 12 should be extended in its bandwidth by outputting an instructing signal 20. The keypad 104 may include an on-and-off control switch or a dipswitch. The keypad 104 may be implemented by a key or keys on a keyboard which is/are assigned respective instruction or instructions. With a soft-phone, for example, the keypad may be implemented as an icon or icons displayed on a display screen of the phone. The block 104 may usually include a display screen on the telephone terminal unit. Such a display screen may be a touch panel. It is, however, simply referred to as a keypad in the present patent application. In this embodiment, the system is adapted to allow the user to simply instruct whether or not the received speech signal 12 be extended in terms of bandwidth, and not to control the characteristic of the highband signal.

The extender control 102 is adapted to be responsive to the operation instructing signal 20, the received speech signal 12 and the transmitting speech signal 18 to generate the operation signal 16 which indicates whether or not the bandwidth extension is to be executed on the signal 12, and the parameter signal 14 which defines the characteristic of the highband signal, or component, for the signal 12 when the operation signal 16 indicates execution of the bandwidth extension.

Figure 2:
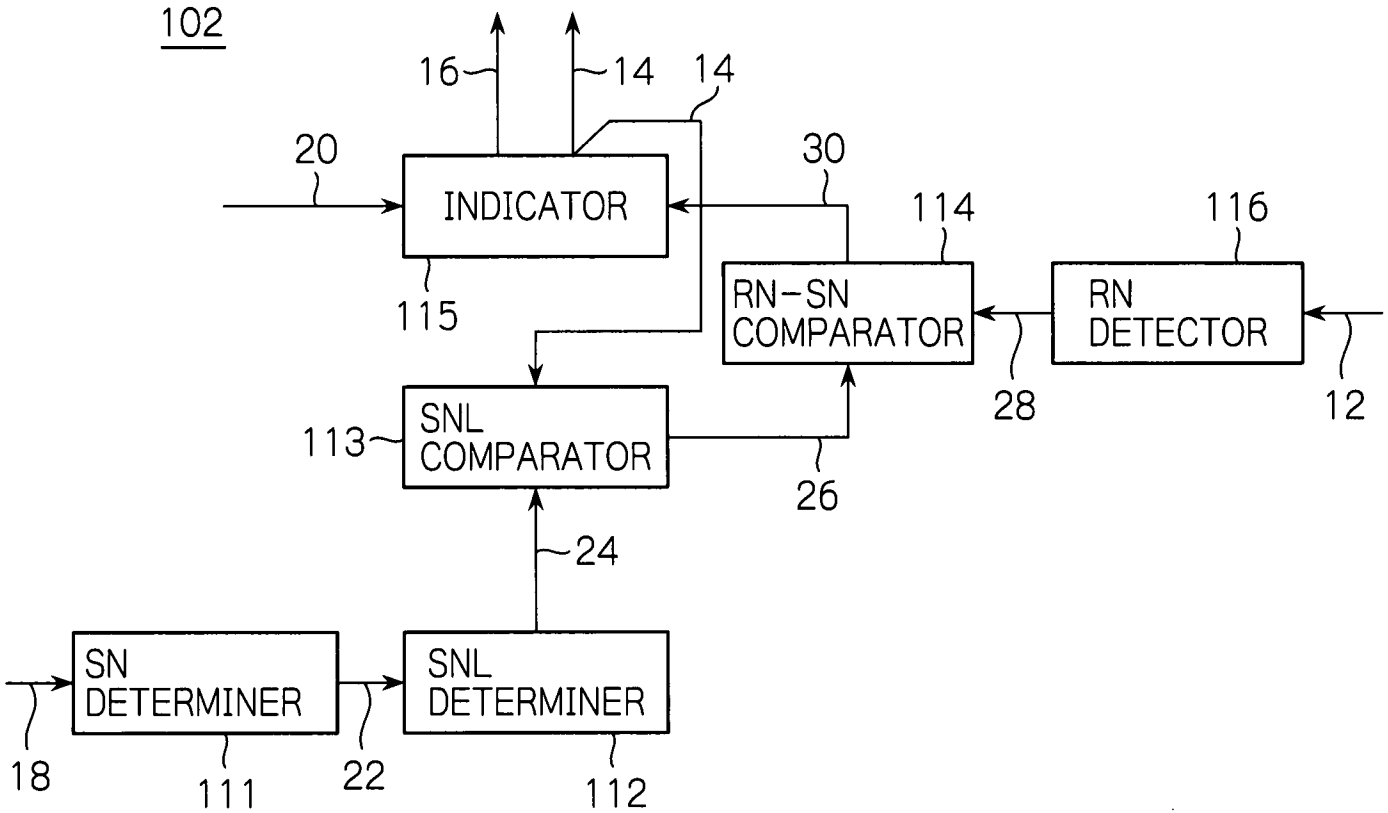
FIG. 2 is a detailed schematic block diagram that shows a configuration of the extender control of the bandwidth extension apparatus shown in FIG. 1.

FIG. 2 is a detailed schematic diagram that shows the configuration of the extender control 102 of the embodiment shown in FIG. 1. Like components are designated with the same reference numerals. In FIG. 2, the extender control 102 comprises a surrounding noise (SN) determiner 111, a surrounding noise level (SNL) determiner 112, a surrounding noise level (SNL) comparator 113, a received-signal noise-to-surrounding noise (RN-SN) comparator 114, an indicator 115 and a received-signal noise (RN) detector 116, which are interconnected as depicted.

The surrounding noise (SN) detector 111 is adapted to determine whether or not the transmitting signal 18 contains noise without a speech signal component which the user intends to send to the remote phone terminal 200. When the SN detector 111 has determined the transmitting signal 18 to be noise, it will output the transmitting signal 18 as a signal under determination, or object signal, 22. When the SN determiner 111 determines the transmitting signal 18 not to be noise, it does not output the signal under determination 22 or outputs as a signal 22 a meaningless or nullified signal, such as a signal containing all zeros. To determine whether or not the inputted signal is noise, some known noise detecting methods are available. For instance, the value of a self correlation function is obtained which is a correlation function between the transmitting speech signal 18 and its delayed signal, and then a delay time at which the self correlation function reaches its maximum is periodically predicted at an interval of, for example, 10 ms. When the delay time predicted is out of the range of 0.14 ms to 1.4 ms, the inputted signal can be determined to be noise because the delay time in case of voice signals will be within this range.

The surrounding noise level (SNL) determiner 112 is adapted to calculate the signal level of the object signal 22, i.e. noise, supplied thereto. The SNL determiner 112 calculates the square-sum of the level of the digital object signal 22 over a predetermined period of time, e.g. 10 ms, to produce a noise level signal 24. However, the scheme of producing the noise level signal 24 may not be restricted to what is described above. For example, frequency analysis is made on the signal under determination 22, and among the results of the frequency analysis the maximum level and the frequency associated therewith may be used as the noise level signal 24.

The SNL determiner 112 and the received-signal noise detector 116 described below may carry out signal level acquisition at a predetermined time interval or at one time per call connection.

The SNL comparator 113 is adapted to get the noise level of the signal 22 as a noise level signal 24 to compare the noise level with a predetermined threshold value. When the noise level exceeds the threshold value, the SNL comparator 113 determines that the filtering profile, or contour, of the highband-suppress filter, not shown, of the extender 101 should be renewed, or updated, so as to reduce its suppression degree, the filtering profile being represented by the parameter signal 14. When the value of the noise level signal 24 having exceeded the threshold value changes to be under the threshold value, the SNL comparator 113 determines that the filtering profile of the highband-suppress filter should be updated so as to increase its suppression degree.

It is possible to provide plural threshold values. In case of two threshold values, when the value of the noise level represented by the noise level signal 24 exceeds the lower threshold value, the SNL comparator 113 selects a filtering profile which reduces the suppression degree one step lower. When the value of the noise level signal 24 exceeds the higher threshold value, the comparator 113 selects a filtering profile which reduces the suppression degree two steps lower. Two distinct threshold values may be provided; one for lowering and the other for raising the suppression degree. When the SNL comparator 113 determines that parameter information in the extender 101 should be updated, it outputs a determination signal 26 representative of identification information indicating an updated filtering profile and the noise level signal 24 used in determination. The SNL comparator 113 is provided with an identification signal 14 representative of the filtering profile currently active in the extender 101 as parameter information, e.g. in the form of pointer described below, by which the SNL comparator 113 can obtain the identification information indicating the filtering profile thus updated.

The received-signal noise (RN) detector 116 serves as receiving the received speech signal 12 and outputs the noise level of the received speech signal 12 as the received speech signal characteristic signal 28. The RN detector 116 may acquire a section of signal 12 where no voice signal is detected in a similar way to the SN determiner 111, and thereafter calculate the noise level of the received signal 12 in the same calculation way as the SNL determiner 112.

The received-signal noise-to-surrounding noise (RN-SN) comparator 114 is responsive to the active determination signal 26 to prepare a parameter signal 30 in a fashion as will be described below. The RN-SN comparator 114 compares the noise levels represented by the received speech signal characteristic signal 28 and the noise level information 24 carried on the determination signal 26 with each other. When the noise level of the transmitting signal 18 is higher than a predetermined multiple, e.g. 1.3, of the noise level of the received speech signal 12, the RN-SN comparator 114 outputs an instructing signal 30 which instructs the indicator 115 not to execute the update of the parameter information. When the noise level of the transmitting signal 18 is equal to or lower than the predetermined multiple of the noise level of the received signal 12, the comparator 114 outputs the identification signal indicative of the parameter information, i.e. the filtering profile to be updated, conveyed on the determination signal 26 as the instructing signal 30.

It is not restricted to the above-described method how to determine whether or not the update must be inhibited when the determination signal 26 has been given. For example, the lower limit for inhibiting the update may be set for the noise level represented by the noise level signal 24. Alternatively, lower limits for inhibiting the update may be set for both of the noise levels of the received speech signal 12 and the noise level signal 24. It is also possible to select a suitable method for determining whether or not the update must be inhibited according to the determination criteria employed in the SNL comparator 113.

The indicator 115 is operative in response to the operation instructing signal 20 received requesting no extension operation to output the operation signal 16 indicating no extension operation without outputting the parameter signal 14. Of course, the indicator 115 may be adapted to output the parameter signal 14, and the extender 101 is in that case adapted to neglect the parameter signal 14.

Figure 3:
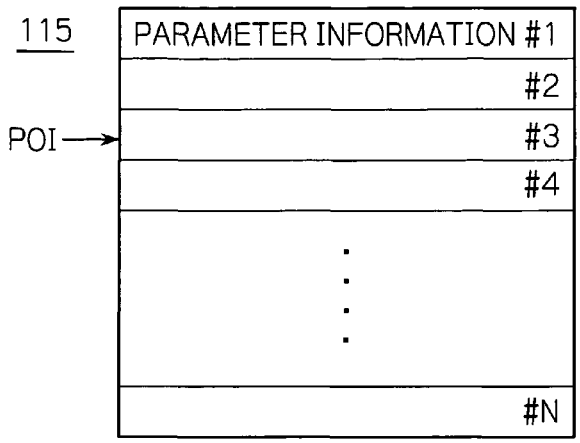
FIG. 3 shows how parameter information is stored in the indicator of the apparatus shown in FIG. 1.

The indicator 115 works as described below when the operation instructing signal 20 inputted thereto requests extension operation. The indicator 115 updates the parameter signal 14 in time with the update instructing signal 30 given, and then outputs the operation signal 16 indicating extension operation and the updated parameter signal 14 to the extender 101. For example, the indicator 115 stores plural pieces of parameter information, as shown in FIG. 3, in the order of the values of the suppression degrees presented by the filtering profile of the highband-suppress filter included in the extender 101, and a pointer POI indicates parameter information to be outputted. By changing the value, i.e. position, of the pointer, the parameter signal 14 to be outputted can be updated.

Now, the operation of the bandwidth extension apparatus 100 will be described, first, in the case where the bandwidth extension is not requested by the user when operating the keypad 104.

In this case, the operation instructing signal 20 which requests no extension operation is outputted from the keypad 104 to the extender control 102. Then, the parameter signal 16 indicating no extension operation is outputted from the extender control 102 to the extender 101. As a result, the received speech signal 12 passes through the extender 101 as it is, and advances to the loudspeaker 105 from which the signal 12 is outputted as vocal sound.

Now, the operation in the extender control 102 will be described specifically. In this case, the operation instructing signal 20 requesting no extension operation is supplied to the indicator 115. The indicator 115, in turn, outputs the signal 16 indicating no extension operation. In this case, it does not matter whether or not the SN determiner 111, the SNL determiner 112, the SNL comparator 113, the RN-SN comparator 114 and the RN detector 116 are rendered enabled. Even when they are enabled, the indicator 115 does not allow the parameter signal 14 outputted therefrom to be updated. The operation instructing signal 20 or the parameter signal 16 which indicates no extension operation is delivered to the SN determiner 111, SNL determiner 112, SNL comparator 113, RN-SN comparator 114 and RN detector 116, to thereby stop the operations of these units.

Next, the operation will be described in the case that the bandwidth extension is instructed by the user when operating the keypad 104. In this case, the operation instructing signal 20 which requests extension operation is outputted from the keypad 104 to the extender control 102, which in turn outputs the operation signal 16 indicating extension operation and the parameter signal 14 to the extender 101. Now, according to the parameter signal 14, the highband-suppress filter included in the extender 101 can suppress the highband signal.

When the extender 101 receives the received speech signal 12, the extender 101 extends the bandwidth of the received speech signal 12 to a highband region to thereby form a bandwidth-extended signal 10. The bandwidth-extended signal 10 is supplied to the loudspeaker 105, which in turn produces corresponding vocal sound. The extender 101 produces the bandwidth-extended signal 10 with the suppression degree for highband signal dependent upon the parameter signal 14.

The extender control 102 will proceed to bandwidth extension in the following manner. The transmitting speech signal 18 is inputted into the SN determiner 111, which in turn determines whether or not the transmitting speech signal 18 is noise. When the SN determiner 111 has determined the transmitting speech signal 18 is noise, it outputs the signal 18 as the object signal under determination 22 to the SNL determiner 112.

From the object signal 22, the SNL determiner 112 acquires the noise level and then supplies the noise level signal 24 to the SNL comparator 113. In the SNL comparator 113, it is determined whether or not update of the parameter signal 14 is needed based on a comparison result of the noise level signal 24 with the threshold value. When update of the parameter signal 14 is needed, the signal indicating the updated parameter signal 14 and the noise level signal 24 are supplied to the RN-SN comparator 114 as the determination signal 26.

In the RN detector 116, the noise level of the received speech signal 12 is acquired to be outputted to the RN-SN comparator 114 as the received speech signal characteristic signal 28.

In the RN-SN comparator 114, it is decided not to update the parameter information when the noise level of the signal 24 is higher than the predetermined multiple of the noise level of the received speech signal characteristic signal 28. Otherwise, the signal defining the updated parameter information included in the determination signal 26 is outputted to the indicator 115 as the update instructing signal 30.

When the indicator 115 receives the update instructing signal 30, it will update the parameter signal 14, which will be supplied to the extender 101. Besides, when the indicator 115 receives the signal 20 indicating extension operation, it outputs the signal 16 indicating extension operation.

With this illustrative embodiment, it is possible to adjust the bandwidth-extended signal automatically or adaptively according to the surrounding hearing situation by using a transmitting speech signal as the signal representing the surrounding hearing situation for the received speech signal. As a result, it is possible to enhance the quality of the outputted voice of the bandwidth-extended signal without user's manual operation.

An alternative embodiment of a bandwidth extension apparatus according to the present invention will be described, referring to FIGS. 4 and 5 of the accompanying drawings.

The alternative embodiment is arranged to predict the characteristic of a bandwidth-extended signal simply from the narrowband signal of a transmitting speech signal and compare the characteristic with the wideband signal of the transmitting speech signal acquired separately so as to correct the band expansion characteristic.

Figure 4:
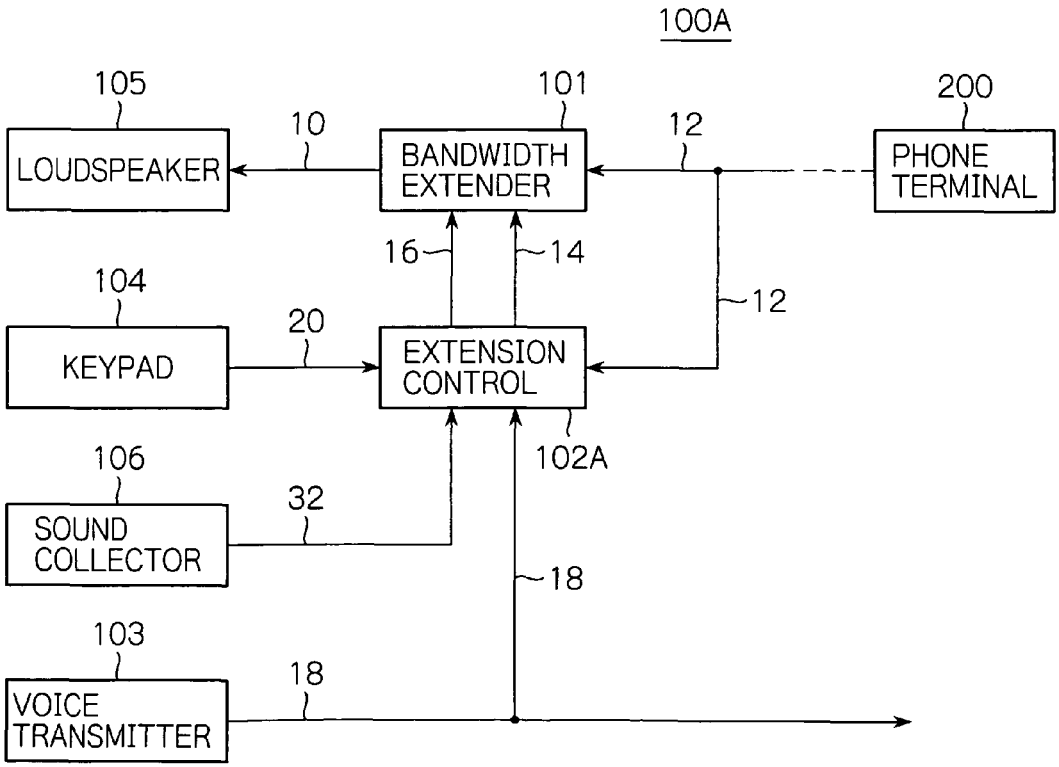
FIG. 4 is a schematic block diagram, like FIG. 1, which shows a configuration of a bandwidth extension apparatus according to an alternative embodiment of the present invention.

FIG. 4 is a schematic block diagram that shows the configuration of the bandwidth extension apparatus according to the alternative embodiment of the present invention. In the figure, the bandwidth extension apparatus 100A according to the alternative embodiment comprises an extender control 102A and a sound collector 106 in addition to the bandwidth extender 101, voice transmitter 103, keypad 104 and loudspeaker 105, which are interconnected as shown.

The bandwidth extender 101 may be the same as with FIG. 1. In the alternative embodiment, the bandwidth extender 101 will be described which is provided with a wideband codebook, an LPC synthesis circuit and a highband-suppress filter, which may be what are described in Omori, et al. In addition, the parameter signal 14 includes the filter coefficient used in LPC synthesis and the wideband codebook.

The sound collector 106 may be an acousto-electric transducer, such as a microphone, which is separately provided from the microphone serving as the transmitter 103. The sound collector 106 is adapted to collect the surrounding, or environmental, sound of the telephone terminal comprising the bandwidth extension apparatus 100A according to the alternative embodiment to output the terminal surrounding sound signal 32 representative of the surrounding sound to the extender control 102A. With the alternative embodiment, the sound collector 106 can capture a wider band of frequency than the transmitter 103. In other words, the sound collector 106 outputs a wideband signal in the form of terminal surrounding sound signal 32 whereas the transmitter 103 outputs a narrowband signal in the form of transmitting speech signal 18. For example, if the upper frequency limit collectable by the transmitter 103 is 4 kHz, then the upper frequency limit collectable by the sound collector 106 shall be 8 kHz. It is, however, preferable that the upper frequency limit collectable by the sound collector 106 is equal to or higher than the upper frequency limit of the extended signal generated by the extender 101 and outputted from the loudspeaker 105.

The extender control 102A according to the alternative embodiment is interconnected to receive the terminal surrounding sound signal 32 in addition to the operation instructing signal 20, received speech signal 12 and transmitting speech signal 18. On the basis of those signals, the extender control 102A produces the operation signal 16 indicating whether or not the extension operation is executed, and further the parameter signal 14 defining the highband signal characteristic when the extension operation is executed, to supply the signals 16 and 14 to the extender 101.

Figure 5:
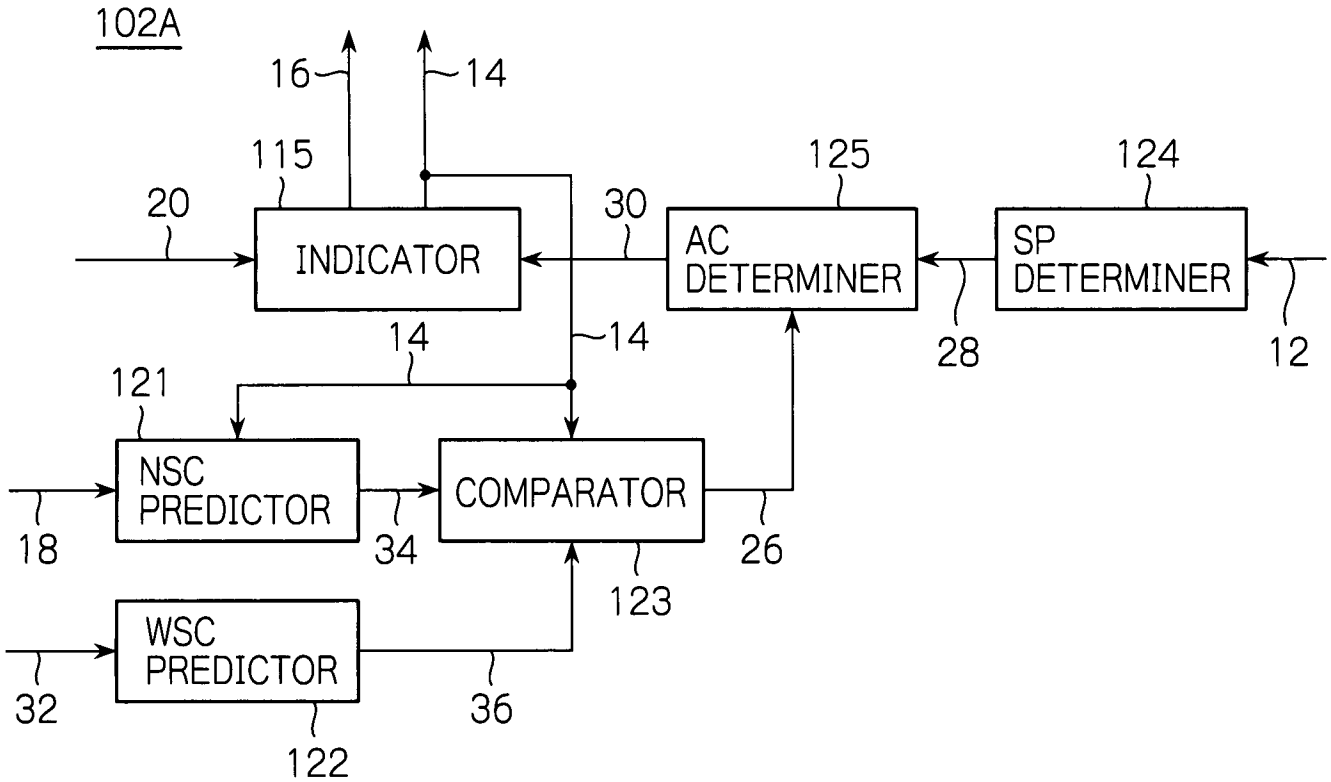
FIG. 5 is a detailed schematic block diagram, like FIG. 2, which shows the configuration of the extender control of the apparatus shown in FIG. 4.

FIG. 5 is a detailed schematic diagram that shows the extender control 102A of the alternative embodiment. As seen from the figure, the extender control 102A comprises, in addition to the indicator 115, a narrowband signal characteristic (NSC) predictor 121, a wideband signal characteristic (WSC) predictor 122, a comparator 123, a signal power (SP) determiner 124 and an adjustment coefficient (AC) determiner 125, which are interconnected as illustrated. The indicator 115 may be the same as the illustrative embodiment shown in and described with reference to FIG. 2.

The narrowband signal characteristic (NSC) predictor 121 is adapted to predict the signal characteristic of the transmitting speech signal 18 and outputs it as a transmitting speech signal characteristic signal 34. The NSC predictor 121 may be implemented by a known LPC analyzer. In this alternative embodiment, the NSC predictor 121 uses the transmitting speech signal 18 and the filter coefficient included in the parameter signal 14 at the time of the LPC synthesis being executed to produce an LPC coefficient CR0 of the transmitting speech signal 18, and uses the filter coefficient for the LPC synthesis and the wideband codebook included in the parameter signal 14 at the time of the LPC synthesis to produce an LPC coefficient CR1 equivalent to that of the transmitting speech signal 18 extended. Further, the NSC predictor 121 calculates the time average of the square-sum of the level of the transmitting speech signal 18 to thereby the signal power of the transmitting speech signal 18, and outputs the calculation result as one of the components of the transmitting speech signal characteristic signal 34.

The wideband signal characteristic (WSC) predictor 122 is adapted to predict the signal characteristic of the terminal surrounding sound signal 32 to output a terminal surrounding sound characteristic signal 36 representative of the resultant characteristic. In an application where the NSC predictor 121 is adapted to perform an LPC analysis as described above, the WSC predictor 122 may also be adapted to perform an LPC analysis. In that application, the predictor 122 does not use a wideband codebook, but has to receive the LPC coefficients CR0 and CR1 included in the transmitting speech signal characteristic signal 34 from the NSC predictor 121 and the LPC coefficients CQ included in the terminal surrounding sound characteristic signal 36 from the WSC predictor 122 in the same order as each other. For example, the tenth order is applicable, but the order may not be restricted to this specific value.

In the alternative embodiment described above, the signal characteristics predicted by the NSC predictor 121 and the WSC predictor 122 are defined as the LPC coefficients. However, other characteristics may be used according to the parameters used by the bandwidth extender 101. For example, it is possible to obtain a specific frequency component by means of a known method such as the Fast Fourier Transform (FFT) and use the frequency characteristic as a predicted signal characteristics.

The comparator 123 is adapted to predict the bandwidth-extended characteristic of the transmitting speech signal 18 from the transmitting speech signal characteristic signal 34 and the parameter signal 14 to compare the prediction result with the signal characteristic of the surrounding wideband signal 32 carried on the terminal surrounding sound characteristic signal 36. In other words, the comparator 123 compares the LPC coefficients obtained from the transmitting speech signal characteristic signal 34 and the terminal surrounding sound characteristic signal 36 to obtain a difference between them and stores the difference correction value as determination information 26.

Here, the difference correction value is a value required to correct a difference between the prediction result and the signal characteristic of the signal 32 in the terminal surrounding sound characteristic signal 36. The alternative embodiment is adapted to use the minimum one of the differences between both LPC coefficients in each of the orders. However, it is not restrictive to use the minimum one. The designer of the extension apparatus can select appropriate one such as to effectually obtain a signal characteristic value, such as a difference between the LPC coefficients in each order, the average of differences between the LPC coefficients in each order or a value resultant from multiplying such values by a suitable conversion coefficient. Instead of differences between the LPC coefficients, a difference correction value for codes in the highband codebook may, when making the LPC coefficient CR1 obtained from the NSC predictor 121 equal to the LPC coefficient CQ obtained from the WSC predictor 122, be obtained to be used as the difference information.

The signal power (SP) determiner 124 is adapted to calculate the signal power of the received speech signal 12 to output a received speech signal characteristic signal 28 indicative of the signal power thus calculated.

The adjustment coefficient (AC) determiner 125 is adapted to calculate an adjustment coefficient as described below to multiply the difference correction value by the adjustment coefficient, and outputs the resultant value as an updated instructing signal 30 in order to update the parameter of the LPC coefficient. The adjustment coefficient is the ratio of the signal power TP included in the received speech signal characteristic signal 28 to the signal power RP included in the determination signal 26, i.e. TP/RP.

The indicator 115 updates the LPC coefficient included in the parameter signal 14 based on the update instructing signal 30 supplied from the AC determiner 125. The indicator 115 of the alternative embodiment is not adapted to store a lot of parameter information but specific parameter information each time updated.

Next, the operation of the bandwidth extension apparatus 100A will be described. The received speech signal 12 is inputted from the phone terminal 200 into the bandwidth extension processor 101, which in turn processes a bandwidth extension so as to add a highband signal to produce the bandwidth-extended signal 10. The bandwidth-extended signal 10 is supplied to the loudspeaker 105, which in turn outputs the signal 10 as vocal sound. When the bandwidth-extended signal 10 is produced, the suppression degree for the highband signal is decided according to the parameter signal 14 supplied from the extender control 102A.

The surrounding sound caused in the environment of the telephone terminal comprising the bandwidth extension apparatus 100A is caught by the sound collector 106, which produces the surrounding sound signal 32, which has its bandwidth broader than the transmitting speech signal 18 outputted from the transmitter 103. The wideband sound signal 32 is outputted to the extender control 102A. To the extender control 102A, the transmitting speech signal 18 and the received speech signal 18 are also inputted.

In turn, the extender control 102A utilizes the parameter signal 14 to form the bandwidth-expanded signal of the transmitting speech signal 18, and obtain a difference correction value between the signal characteristics of the bandwidth-extended signal and the wideband sound signal 32, i.e. LPC coefficients in this embodiment. Then, the extender control 102A adjusts the difference correction value according to the ratio in power level of the transmitting speech signal 18 and the received speech signal 12, and uses the adjusted difference correction value to correct the parameter signal 14 depending on the difference correction value. The extender control 102A will then operate as described below.

The signal characteristic of the transmitting speech signal 18 is predicted by the NSC predictor 121 and outputted as the transmitting speech signal characteristic signal 34. At the same time, the signal power RP of the transmitting speech signal 18 is also calculated. Further, the signal characteristic of the terminal surrounding sound signal 32 is predicted by the WSC predictor 122 and outputted as the terminal surrounding sound characteristic signal 36.

In the comparator 123, the bandwidth-extended characteristic of the transmitting speech signal 18 is predicted from the transmitting speech signal characteristic signal 34 and the parameter signal 14, and the prediction result is compared with the signal characteristic represented by the terminal surrounding sound characteristic signal 36. As a result, the difference correction value is calculated and stored as the determination information 26. The value of the signal power RP is also included in the determination signal 26. Besides, the determination signal 26 may be arranged such as to indicate no adjustment. In the latter case, in order not to execute the adjustment, "no adjustment" may be indicated when, for example, a difference in the lower orders of frequency, e.g. the first to fifth orders among ten orders, between LSP coefficients, known per se, to which the LPC coefficients CR1 and CQ, or CR0 and CQ, have been converted exceeds a predetermined frequency, e.g. 100 Hz. In this case, the object signal under determination 26 may be set meaningless, e.g. include all zeros, to be outputted as the determination signal 26 as with the embodiment shown in FIG. 2. In the case of using the difference in the highband codebook also, the determination signal 26 may be arranged to indicate no adjustment.

The signal power TP of the received speech signal 12 is calculated by the SP determiner 124 and supplied to the AC determiner 125.

In the AC determiner 125, the difference correction value between the predicted characteristic of the bandwidth-extended signal of the transmitting speech signal 18 and the signal characteristic represented by the terminal surrounding sound characteristic signal 36 is multiplied by the adjustment coefficient that is the ratio of the signal power TP of the received speech signal to the signal power RP of the transmitting speech signal. Then, according to the multiplication result, the parameter signal 14 is updated. In the alternative embodiment, the calculation of the adjustment coefficient and the update of the parameter signal 14 are carried out anytime. However, the update may be carried out at a regular interval, e.g. every ten second, or at a fixed number of times, e.g. once at the beginning of a call session.

With the alternative embodiment, it is possible to correct the signal characteristic of the bandwidth-extended signal adaptively according to a difference correction value which is obtained from a difference between the wideband characteristic of the bandwidth-extended signal predicted by using the transmitting speech signal and the wideband signal characteristic acquired at the same location as the transmitting speech signal captured. It is thus possible to enhance the quality of the voice generated from the bandwidth-extended signal without user's manual operation.

Figure 6:
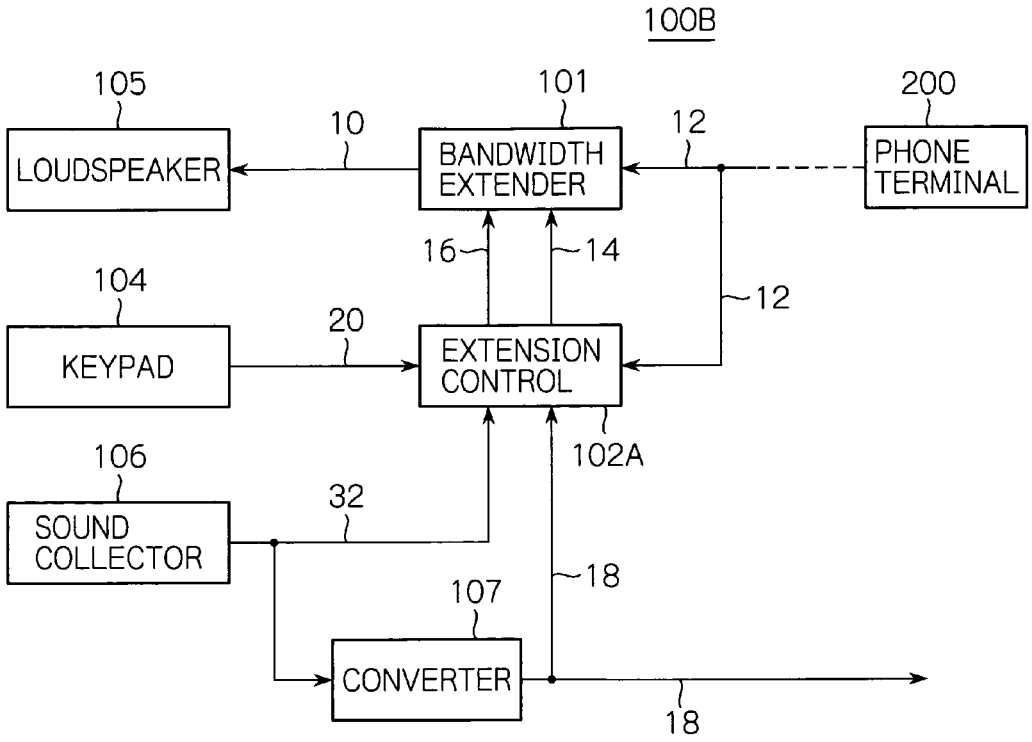
FIG. 6 is a schematic block diagram, like FIG. 1, which shows a configuration of another alternative bandwidth extension apparatus according to present invention.

The illustrative embodiments shown in FIGS. 1 through 4 may further be modified in addition to the modifications described above. Now, a reference will be made to FIG. 6, which shows in a schematic diagram the configuration of the bandwidth extension apparatus 100B according to another alternative embodiment modified from the embodiment shown in FIG. 4. In the bandwidth extension apparatus 100B, the voice transmitter 103, FIG. 4, is dispensed with. Instead, the instant alternative embodiment includes a converter 107, which is adapted to filter off the higher frequency component from the terminal surrounding sound signal 32 outputted from the sound collector 106 in order to form the transmitting speech signal 18 to be transmitted toward the remote terminal 200. The remaining components may be the same as the embodiment shown in FIG. 4.

In the embodiment shown in FIG. 1, the suppression degree of the highband signal is adjustable on the basis of the noise level. Alternatively, it is possible to set a frequency range to be expanded on the basis of noise information.

The frequency range f [Hz] to be expanded is expressed by the following expression (1), where the basic frequency range f1 [Hz], the noise level Ln [dBov] included in the noise level signal 24 and the noise level Ls [dBov] included in noise level information of the received speech signal characteristic signal 28, $$f=(Ln-Ls)\times fa+f1. \quad (1)$$

In the expression, fa is a coefficient used to convert a level difference into a frequency, for example, 12.5. Also, as the basic frequency "f1", 6,800 Hz is applied, for example. Besides, the value of (Ln−Ls) usually falls between −40 to 40. If the value exceeds 40, the value shall remain 40. If the value falls below than −40, the value shall maintain −40. However, these specific values are not restrictive but may be optionally designed according to the situation or application in which the telephone terminal is involved.

In the illustrative embodiments described above, the bandwidth extender 101 comprises the wideband codebook, the LPC synthesis circuit and the highband-suppress filter. However, the bandwidth extender 101 may be adapted not to use an LPC synthesis, but to analytically generate a quasi-highband signal rather than the wideband codebook, for example. Further, in this case, parameters to be used may not be restricted to the filtering profile of the highband-suppress filter and the filter coefficient for the LPC synthesis, but may be either one of the filtering profile and the filter coefficient, or any other features different therefrom.

In the illustrative embodiments, the bandwidth extension apparatus serves as changing the sampling rate of the sound signals according to the bandwidth extension, e.g. from 8 kHz to 16 kHz. However, the values of sampling frequency may not be restricted to the above-mentioned specific values. Also, the bandwidth extension apparatus may be arranged such as to simply extend the band of frequency components of a voice signal without changing its sampling frequency.

The entire disclosure of Japanese patent application No. 2009-82690 filed on Mar. 30, 2009, including the specification, claims, accompanying drawings and abstract of the disclosure, is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

What is claimed is:

1. A bandwidth extension apparatus for extending a frequency bandwidth of an inputted speech signal in accordance with a parameter, comprising:

a surrounding characteristic predictor for collecting a surrounding sound of a place where a bandwidth-extended speech signal will be outputted, then estimating a characteristic of the surrounding sound, and predicting an amount of the characteristic;

an adjustment amount predictor for comparing the amount of the characteristic with the parameter to predict an adjustment amount for the parameter;

a speech characteristic predictor for estimating the characteristic of the inputted speech signal, and then predicting the amount of the characteristic of the inputted speech signal; and an adjustment amount determiner for comparing the amounts of characteristics of the surrounding sound and the inputted speech signal with each other to determine an effective adjustment amount which will be applied to bandwidth extension, and updating the parameter.

2. The apparatus according to claim 1, wherein said apparatus is included in a phone terminal.

3. A bandwidth extension apparatus for extending a frequency bandwidth of an inputted speech signal in accordance with a parameter, comprising:

a first surrounding characteristic predictor for collecting a surrounding sound of a place where a bandwidth-extended speech signal will be outputted, then estimating a characteristic of the surrounding sound, and predicting an amount of the characteristic;

a second surrounding characteristic predictor for converting the surrounding sound to a signal having a characteristic substantially equivalent to the inputted speech signal, and using the parameter used for bandwidth extension to predict the amount of the characteristic of the converted surrounding sound;

an adjustment amount predictor for predicting a parameter such that the amount of the characteristic of said second surrounding characteristic predictor is made approximate to the amount of the characteristic of said first surrounding characteristic predictor, and then predicting an adjustment amount for the parameter;

a speech characteristic predictor for estimating the characteristic of the inputted speech signal, and then predicting the amount of the characteristic of the inputted speech signal; and an adjustment amount determiner for comparing the amounts of characteristics of the surrounding sounds and the inputted speech signal with each other to determine an effective adjustment amount which will be applied to the bandwidth extension, and updating the parameter.

4. The apparatus according to claim 3, wherein said apparatus is included in a phone terminal.

5. A bandwidth extension method for extending a frequency bandwidth of an inputted speech signal in accordance with a parameter, comprising the steps of:

collecting a surrounding sound of a place where a bandwidth-extended speech signal will be outputted, then estimating a characteristic of the surrounding sound, and predicting an amount of the characteristic;

comparing the amount of the characteristic with the parameter to predict an adjustment amount for the parameter;

estimating the characteristic of the inputted speech signal, and then predicting the amount of the characteristic of the inputted speech signal; and comparing the amounts of characteristics of the surrounding sound and the inputted speech signal to determine an effective adjustment amount for the parameter which will be applied to bandwidth extension, and updating the parameter.

6. A bandwidth extension method for extending a frequency bandwidth of an inputted speech signal in accordance with a parameter, comprising the steps of:

collecting a surrounding sound of a place where a bandwidth-extended speech signal will be outputted, then estimating a characteristic of the surrounding sound, and predicting an amount of a first surrounding characteristic as a first characteristic amount;

converting the surrounding sound to a signal having a characteristic substantially equivalent to the inputted speech signal, and using the parameter used for bandwidth extension to predict the amount of the characteristic of the converted surrounding sound as a second characteristic amount;

predicting a parameter such that the second characteristic amount is made approximate to the first characteristic amount, and then predicting an adjustment amount for the parameter;

estimating the characteristic of the inputted speech signal, and then predicting the amount of the characteristic of the inputted speech signal; and comparing the amounts of characteristics of the surrounding sounds and the inputted speech signal with each other to determine an effective adjustment amount which will be applied to the bandwidth extension, and updating the parameter.

7. A non-transitory computer-readable medium on which is stored a bandwidth extension program for extending a frequency bandwidth of an inputted speech signal in accordance with a parameter by executing on a computer the steps of:

collecting a surrounding sound of a place where a bandwidth-extended speech signal will be outputted, then estimating a characteristic of the surrounding sound, and predicting an amount of the characteristic;

comparing the amount of the characteristic with the parameter to predict an adjustment amount for the parameter;

estimating the characteristic of the inputted speech signal, and then predicting the amount of the characteristic of the inputted speech signal; and comparing the amounts of characteristics of the surrounding sound and the inputted speech signal with each other to determine an effective adjustment amount for the parameter which will be applied to bandwidth extension, and updating the parameter.

8. A non-transitory computer-readable medium on which is stored a bandwidth extension program for extending a frequency bandwidth of an inputted speech signal in accordance with a parameter by executing on a computer the steps of:

collecting a surrounding sound of a place where a bandwidth-extended speech signal will be outputted, then estimating a characteristic of the surrounding sound, and predicting an amount of a first surrounding characteristic as a first characteristic amount;

converting the surrounding sound to a signal having a characteristic substantially equivalent to the inputted speech signal, and using the parameter used for bandwidth extension to predict the amount of the characteristic of the converted surrounding sound as a second characteristic amount;

predicting a parameter such that the second characteristic amount is made approximate to the first characteristic amount, and then predicting an adjustment amount for the parameter;

estimating the characteristic of the inputted speech signal, and then predicting the amount of the characteristic of the inputted speech signal; and comparing the amounts of characteristics of the surrounding sounds and the inputted speech signal with each other to determine an effective adjustment amount which will be applied to the bandwidth extension, and updating the parameter.

* * * * *